United States Patent [19]

Horiuchi

[11] Patent Number: 4,605,383

[45] Date of Patent: Aug. 12, 1986

[54] TOY BLOCK TRANSFORMED INTO A ROBOT

[75] Inventor: Shigeyuki Horiuchi, Tokyo, Japan

[73] Assignee: Mattel, Inc., Hawthorne, Calif.

[21] Appl. No.: 757,415

[22] Filed: Jul. 22, 1985

[30] Foreign Application Priority Data

Dec. 29, 1984 [JP] Japan ..... 59-279135

[51] Int. Cl.[4] ..... A63H 3/46

[52] U.S. Cl. ..... 446/376; 446/487

[58] Field of Search ..... 446/376, 487, 489, 101, 446/268, 85, 97, 99; D21/166, 149, 148, 155; 434/171, 172

[56] References Cited

U.S. PATENT DOCUMENTS

| | | | |
|---|---|---|---|
| 152,250 | 6/1874 | Powers | 446/310 |
| 1,541,004 | 6/1925 | Taylor . | |
| 2,496,810 | 2/1950 | Nerrie | 35/71 |
| 2,751,634 | 6/1956 | Washington | 20/0.5 |
| 3,365,198 | 1/1968 | Hay | 446/85 X |
| 4,411,097 | 10/1983 | Murakami | 446/376 |

FOREIGN PATENT DOCUMENTS 17408 of 1910 United Kingdom .

*Primary Examiner*—Mickey Yu

*Attorney, Agent, or Firm*—Ronald M. Goldman; John G. Mesaros; Melvin A. Klein

[57] ABSTRACT

A toy block constructed into one block with a plurality of members and having a front elevational face embossed by a symbol such as one letter of the alphabet, the block having a body member with pivotable shoulder and leg members, and a telescopically mounted head member. The shoulder members house a pair of extendible arm members with integrally formed hands. The block may be transformed into a humanoid figure such as a robot by manipulating the various members by hand.

5 Claims, 6 Drawing Figures

TOY BLOCK TRANSFORMED INTO A ROBOT

BACKGROUND OF THE INVENTION

The background of the invention will be discussed in two parts:

Field of the Invention

This invention relates to toy blocks, and more particularly to a toy block having an alphanumeric symbol thereon, the block being configured with positionable parts for transforming the block into a humanoid figure, such as a robot.

Description of the Prior Art

Toy blocks having alphanumeric or other symbols thereon have been a source of learning and amusement for children. When such toy blocks are provided with other attributes, such as interlock or puzzle means, the popularity has increased.

One such form of alphabetical device is shown and described in British Pat. No. 17,408, by Hough, entitled "Combination Alphabetical, Numeral, and Figure Puzzle", specification accepted Mar. 23, 1911, in which the device includes a plurality of members, pivotally connected in such a way that various alphanumeric depictions may be created in stick form.

Another such alphanumeric structure is shown and described in U.S. Pat. No. 1,541,004, entitled "Alphabetical Toy," issued to Taylor on June 9, 1925, the toy being a set of devices, with each formed of pivotally connected stick members.

U.S. Pat. No. 2,496,810, directed to "Educational Link," was issued to Nerrie on Feb. 7, 1950, and illustrates a device in which a plurality of stick members share one or more common pivots for enabling manipulation of the various sticks into various shapes and letters and the like.

U.S. Pat. No. 2,751,634, entitled "Articulated Structure," issued to Washington, on June 26, 1956, such patent disclosing a structure having arcuate portions pivotally connected to one another in such a way that they may be manipulated to form one or more figures.

It is an object of the present invention to provide a new and improved toy block.

It is another object of the present invention to provide a new and improved toy block having an alphanumeric representation thereon.

It is a further object of the present invention to provide a new and improved toy alphanumeric block having pivotable and positionable components, which may be selectively manipulated to form a humanoid or like figure.

It is still another object of the present invention to provide a new and improved toy block which is constructed with a plurality of members having respectively different shapes and has a front elevational face embossed by one symbol, such as a letter of the alphabet, and which may be transformed into a robot by turning and pulling out said members.

SUMMARY OF THE INVENTION

The foregoing and other objects are accomplished by providing a toy block constructed into one block with a plurality of members and having a front elevational face embossed by one letter of the alphabet, the block having a body member with pivotable shoulder and leg members, and a telescopically mounted head member. The shoulder members house a pair of extendible arm members with integrally formed hands. The block may be transformed into a humanoid figure such as a robot by manipulating the various members by hand.

Other objects, features and advantages of the invention will become apparent from a reading of the specification, when taken in conjunction with the drawings, in which like reference numerals refer to like elements in the several views.

DESCRIPTION OF THE PREFERRED EMBODIMENT

Figure 1:
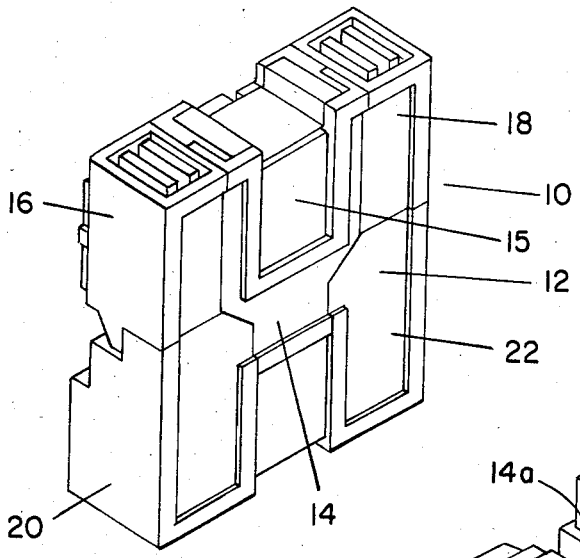
FIG. 1 is a perspective view of a toy block in accordance with the present invention.

Referring now to the drawings, and particularly to FIG. 1, there is shown a toy block, generally designated 10, in generally regular cubical form, with the front face 12 thereof having embossed thereon an alphanumeric depiction of the letter "H". The front face 12 is formed of the adjacent contiguous surfaces of a plurality of members including main body member 14, a head member 15, first and second upper shoulder members 16 and 18, and first and second lower leg members 20 and 22, the terms "upper" and "lower", as used herein referring to the preferred orientation of the block 10.

Figure 2:
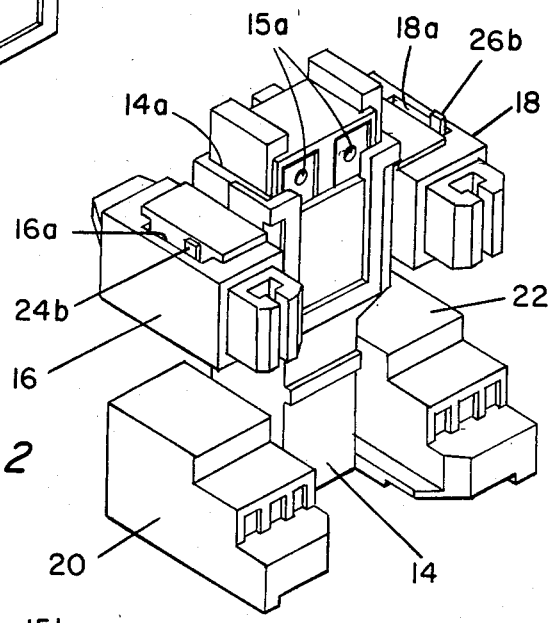
FIG. 2 is a perspective view of the toy block of FIG. 1 which has been transformed into a robot.
Figure 3:
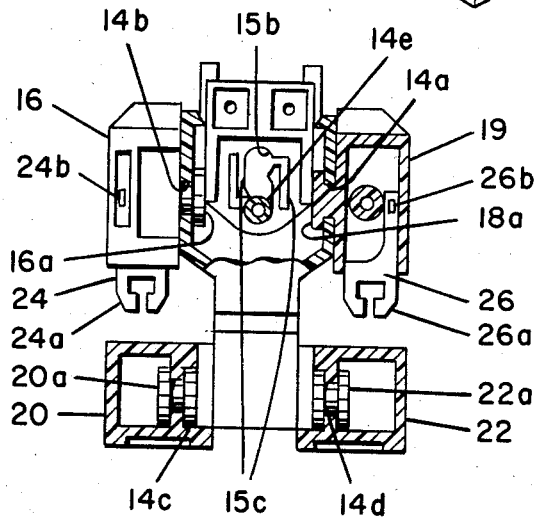
FIG. 3 is a front elevational view of the transformed block of FIG. 2, partially in cross-section.

As shown also in FIGS. 2 and 3, the various parts are pivotable and telescoping, with matingly coacting parts, which when unrotated and unextended, as depicted in FIG. 1, provide the normal appearance of a block; and when rotated and extended, provide a humanoid or robot-like appearance. The upper shoulder members 16 and 18 are pivotally connected to the upper portion of the main body member 14 by journal portions **16*a* and 18*a* formed integrally with the shoulder members and fitted into socket apertures 14*a* and 14*b*, respectively of the main body member 14**.

Similarly, the leg members 20 and 22 are pivotally coupled to the main body member 14 by means of journal portions **20*a* and 22*a* fitting within mating socket apertures 14*c* and 14*d*, respectively, formed in the main body member 14. As shown in FIGS. 2 and 3, the leg members 20 and 22 are enlarged block-shaped members with integrally formed stepped foot portions, and leg members 20 and 22** may be pivoted through an angle of ninety degrees for supporting the humanoid, or robot-like figure.

The shoulder members 16 and 18 may likewise be pivoted from the depending position shown in FIG. 1 to a horizontal position as shown in FIG. 2. The interiors of the shoulder members 16 and 18 are generally hollow and telescopically support first and second arm members 24 and 26, respectively, with the arm members 24 and 26 having integrally formed hand portions 24*a* and 26*a*, which may be formed as robot-like claws. To facilitate extension and retraction of the arm members 24 and 26 from within the shoulder members 16 and 18, the arm members are provided with integrally formed lever members 24*b* and 26*b*, respectively, which are slidable within slots 16*a* and 18*a* of shoulder members 16 and 18.

The head member 15 is likewise telescopically received within a mating opening 14*a* formed in the upper portion of the generally hollow main body member 14, with the viewable front portion of head member 15 having simulated eyes 15*a* formed therein. As depicted in FIG. 3, the rear wall of the head member 15 is provided with a slotted opening 15*b* formed between resilient tine members 15*c*, with a shaft 14*e* secured within main body member 14 passing through the slotted opening. As the head member 15 is withdrawn, the lower end of one of the tine members 15*c* coacts with the shaft 14*e* for retaining the head member in the extended position.

For esthetic purposes, the various coacting edges and rear surface of the block 10 may be configured, embossed, staggered or recessed to simulate additional features, such as the enlarged biceps of the shoulder members 16 and 18, and the simulated toes of the leg members 20 and 22, or other like features which enhance the robot appearance.

Figure 4:
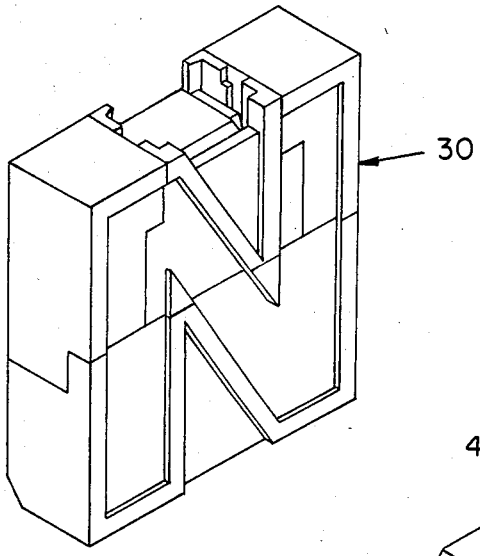
FIG. 4 is a perspective view of another toy block, similar to the block of FIG. 1, with the front elevational view thereof having embossed thereon another alphanumeric character.
Figure 5:
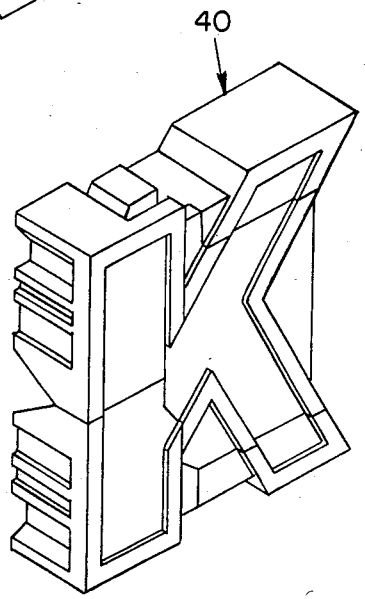
FIG. 5 is a perspective view of another toy block, similar to the block of FIG. 1, with the front elevational view thereof having embossed thereon still another alphanumeric character.
Figure 6:
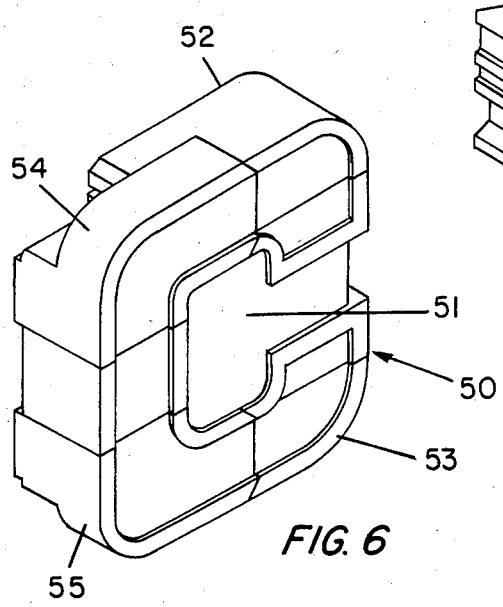
FIG. 6 is a perspective view of another toy block, similar to the block of FIG. 1, with the front elevational view thereof having embossed thereon yet another alphanumeric character.

FIGS. 4 through 6 depict other toy blocks 30, 40 and 50, which have embossed on the front elevational faces thereof the letters "N", "K", and "C", respectively, with each of the toy blocks likewise being formed of a plurality of members which may be rotated, extended, or otherwise manipulated to form the appearance of a humanoid or the like. It is to be understood however, that although the blocks 30, 40 and 50 are depicted in the normal viewing position for the alphanumeric character thereon, that in use as a humanoid, any one of the blocks may be manipulated to another position for support thereof.

For example, referring to FIG. 6, the block 50 has a main body member 51, shoulder members 52 and 53, and leg members 54 and 55. However, for support of the robot formed thereby on the leg members 54 and 55, the block must be rotated ninety degrees to the left. Consequently, it can be seen that the orientation of the alphanumeric character on the front face is not controlling as to the orientation of the humanoid figure formed thereby. It is also to be understood that other humanoid figures may be simulated, such as animals, insects and the like, and the term humanoid as used herein is intended to encompass such other simulated figures.

Thus, by turning and/or pulling out these members, the toy blocks 10, 30, 40 and 50 may be transformed into the robot or other humanoid figure, and the letter of the alphabet embossed on the front elevational face thereof disappears. The transformed toy block may then be returned to the original shape by the reverse manipulation and the letter of the alphabet reappears on the front elevational face of the block.

While there has been shown and described a preferred embodiment, it is to be understood that various other adaptations and modifications may be made within the spirit and scope of the invention.

I claim:

1. In a toy block capable of being transformed into another form, the combination comprising:

a main body member having a hollow portion therein;

a pair of shoulder members pivotally coupled to said main body member;

a pair of leg members pivotally coupled to said main body member; and a head member slidably coupled to said main body member for being received within said hollow portion thereof, said shoulder members and said leg members when pivoted to a first position with respect to said main body member provide a contiguous surface having embossed thereon an alphanumeric symbol viewable only with said shoulder members and said leg members in said first position.

2. The combination according to claim 1 wherein said shoulder members are generally hollow and include arm members telescopically received therein.

3. The combination according to claim 2 wherein said shoulder members, said leg members and said head member are configured to provide the form of a humanoid with said shoulder and leg members pivoted to a second position with respect to said main body member and said head member withdrawn from said hollow portion.

4. The combination according to claim 2 wherein said arm members further include lever means operable within slots formed in said shoulder members for extending said arm members.

5. The combination according to claim 3 wherein said leg members having integrally formed foot portions.

* * * * *